US006475565B1

(12) United States Patent
Lukschandel et al.

(10) Patent No.: US 6,475,565 B1
(45) Date of Patent: Nov. 5, 2002

(54) PROCESS FOR PRODUCING A CLOTHING WIRE FOR OPEN-END SPINNING

(75) Inventors: Jörg Lukschandel, Kempten (DE); Manfred Menge, Sulzberg (DE); Jürgen Meyer, Kempten (DE)

(73) Assignee: Elektroschmelzwerk Kempten GmbH, Kempten (DE)

( * ) Notice: Subject to any disclaimer, the term of this patent is extended or adjusted under 35 U.S.C. 154(b) by 0 days.

(21) Appl. No.: 09/697,109

(22) Filed: Oct. 26, 2000

(30) Foreign Application Priority Data

Oct. 27, 1999 (DE) ..... 199 51 775

(51) Int. Cl.[7] ..... C23C 16/26; B05D 3/00; B05D 1/36; C25D 15/00

(52) U.S. Cl. ..... 427/249.7; 427/299; 427/383.1; 427/404; 427/902; 205/109; 205/206; 205/224; 205/171; 205/181; 205/199

(58) Field of Search ..... 427/299, 327, 427/435, 180, 249.7, 383.1, 404; 205/138, 210, 109, 110, 224, 171, 181, 199

(56) References Cited

U.S. PATENT DOCUMENTS

| | | | | |
|---|---|---|---|---|
| 2,731,676 A | | 1/1956 | Apthorp | 19/114 |
| 2,937,413 A | | 5/1960 | Hollingsworth | 19/114 |
| 3,833,968 A | | 9/1974 | Arai | 19/114 |
| 3,883,410 A | * | 5/1975 | Inoue | 204/129.46 |
| 4,233,711 A | | 11/1980 | Hollingsworth | 19/114 |
| 4,435,953 A | | 3/1984 | Schmid | 57/408 |
| 5,006,367 A | | 4/1991 | Lancsek | 427/129 |
| 5,547,709 A | | 8/1996 | Luckschandel et al. | 427/299 |
| 6,289,588 B1 | * | 9/2001 | Graf | 29/895.31 |

FOREIGN PATENT DOCUMENTS

| | | |
|---|---|---|
| DE | 24 33 769 | 7/1974 |
| DE | 43 14 161 | 4/1993 |
| EP | 0 861 930 | 1/1998 |
| EP | 0 953 662 | 4/1998 |
| GB | 2 146 586 | 4/1985 |
| GB | 2 182 612 | 5/1987 |

OTHER PUBLICATIONS

Patent Abstract of Japan vol. 1995, No. 8 Corresp. to JP 07 118935 A Sep. 5, 1995.

English Derwent Abstract 1995–593151 [51] Corresp. to EP 0953 662 A1 Nov. 3, 1999.

Metalloberfläche 38 1984, No. 4 p. 139 no month available.

J. Lukschandel "Putting Diamonds to Work in Textile Machinery", Textile Month, May 1981.

Meissner/Wanke, Handbuch Federn, 2nd Edition 1993, pp. 62–63, Verlag Technik Berlin–Munich no month available.

F. Schäfer, Entgraten–Theorie, Verfahren, Anlagen (Deburring Theory, Process, Installations) 1975, pp. 160–166; Krausskopf–Verlag no date available.

(List continued on next page.)

*Primary Examiner*—Edna Wong
(74) *Attorney, Agent, or Firm*—Collard & Roe, P.C.

(57) ABSTRACT

The invention relates to a process for producing a clothing wire which is suitable for fitting to an opening-cylinder base body, wherein a raw wire which is customarily used to produce clothing wire is processed on end to form a wire coil, in which the teeth of the wire are perpendicular to the coil axis and which has a diameter which corresponds to the diameter of the opening-cylinder base body or differs by at most ±5% from the diameter of the opening-cylinder base body, and the wire coil is pushed loosely onto a support device and, together with this device, is introduced into an electroplating unit, the process steps which are customarily used for the chemical deburring of a raw wire and the nickel-diamond coating of a clothed opening cylinder taking place in the electroplating unit, and the clothing wire being removed from the electroplating unit.

24 Claims, 1 Drawing Sheet

OTHER PUBLICATIONS

W. Riedel: Funktionelle Chemische Vernickelung (Functional Chemical Nickel–Plating), Leuze–Verlag, 1989, p. 177 no date available.

Lehrgangsunterlagen Entgrat–Technik 95, TA Esslingen, no date available.

Technologie der Galvanotechnik (Electroplating Technology); Gaida/Aβmann: Leuze Verlag, 1st Edition 1996 no month available.

English Derwent Abstract corresponding to EPO 861 930 Jan. 28, 1998 .

English Derwent Abstract corresponding to DE 24 33 769 Jan. 22, 1976.

* cited by examiner

Fig. 1
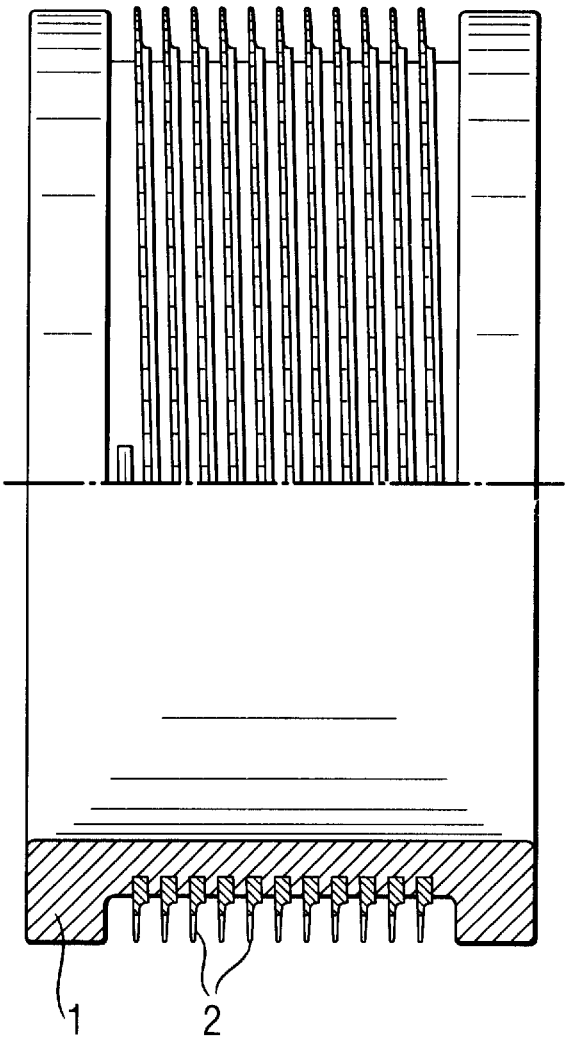
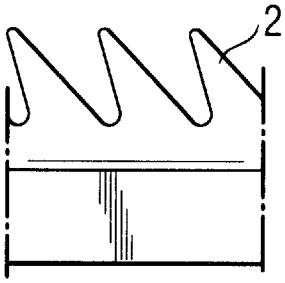
Fig. 2b
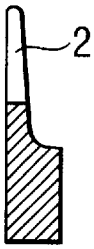
Fig. 2a

PROCESS FOR PRODUCING A CLOTHING WIRE FOR OPEN-END SPINNING

FIELD OF THE INVENTION

The invention relates to a process for producing a clothing wire for open-end spinning.

Open-end spinning (OE spinning) is currently the most economic process for producing yarns from short fibers. Approximately one third of global production of yarns of this type uses the OE spinning process. There are approximately 6 millions OE spinning units in operation.

BACKGROUND OF THE INVENTION

The most essential components of the open-end spinning unit are the opening cylinder and the spinning rotor. The opening cylinder separates the feed sliver into its individual fibers, just a few micrometers thick, removes impurities and feeds the fibers through a feed tube into the spinning rotor, where they are reassembled to form a yarn. The working of the opening cylinder has a crucial bearing on the stability of the spinning process and on the quality of the yarn product.

A common form of opening cylinder is a cylindrically shaped base body made from aluminum or steel, whose circumferential surface is equipped with a helical slot fitted with a finely toothed steel tape—the wire clothing—fixed in place by calking. FIG. 1 shows a partly cut-away opening cylinder comprising an aluminum base body 1 and the clothing wire spiral 2.

Examples of opening cylinders and toothed tapes or wires may be found inter alia in U.S. Pat. Nos. 2,937,413, 4,233,711, 2,731,676, 4,435,953 and 3,833,968. The toothed tapes ("clothings") are usually produced by rolling an initially round wire into a profile tape with the characteristic cross-sectional shape (see FIG. 2*a*) and then stamping out the teeth from the flat part of this profile tape. Such a clothing wire is shown in cross section in FIG. 2*a* and in a partial side view in FIG. 2*b*. Sometimes the tooth flanks are subjected to a mechanical after-treatment by grinding. This is described for example in U.S. Pat. No. 4,233,711.

A clothing wire obtained after these production steps is referred to as a raw wire. A wire of this type is commercially available, for example under the name OE-M-3325 CSH from Graf/CH-Rapperswil. The edges of the teeth of the raw wire are sharp and in part very rough. Opening cylinders equipped with a clothing wire in this state have completely unacceptable spinning characteristics, since the fine fibers are destroyed by the raw wire or become lodged in the rough areas of the teeth, only to become detached from time to time and create thick places in the yarn product.

It is therefore common practice to subject the raw wires, prior to mounting as clothing wire on the base body, to a material-removing process comprising an electrolytic or chemical treatment. To this end, the raw wire is successively degreased, descaled, pickled and deburred in various electrolytic and/or chemical baths. Thorough rinsing is necessary between the actual operations. These treatment steps serve to round the sharp edges of the raw wire and to generally improve the surface quality. However, the entire process is laborious and costly.

Since particularly high demands are imposed on the dimensional accuracy of the clothing wire for OE opening cylinders, this wire is generally not treated electrolytically, but rather by the more complex chemical deburring process.

The surface state of the teeth resulting from this treatment is known as needle finish. It is considered absolutely mandatory for satisfactory working of an opening cylinder equipped with wire clothing. A reference to this needle finish may be found for example in U.S. Pat. No. 5,006,367, column 2, lines 9–10.

It is also common practice to protect the teeth of the clothing wire of opening cylinders from wear, and hence to prolong the useful life of opening cylinders by specific surface-technological measures. A particularly effective measure is the application to the needle-finished, wire-clothed opening cylinder of a dispersion layer consisting of autocatalytically deposited nickel with embedded diamond particles. This is described inter alia in Metalloberfläche 1984, No. 4, page 139 or Textile Month, May 1981. Opening cylinders equipped with such a nickel-diamond coating have service lives which exceed those of uncoated opening cylinders by a factor of from five to ten.

Like the above-described deburring and rounding treatment of raw wire, a nickel-diamond coating requires a multistage treatment in dip baths, so that it is desirable to combine the two time-consuming, expensive processes in an economical manner.

A corresponding process for providing opening cylinders which have a raw wire clothing with a needle finish and a diamond coating in a single pass is described, for example, in DE 4314161 A1 (corresponding to U.S. Pat. No. 5,547,709).

When the clothing wire is rolled into the helical slot of the cylinder base body ("clothing"), uncoated, straight wire is introduced from relatively large reels, under considerable tension, into the slot of the slowly rotating cylinder body and is clamped at the sides by mechanical deformation of the web between the turns of the slot by means of narrow rollers. During this operation, the clothing wire undergoes considerable plastic deformation in the region of the tooth base, since it is considerably stretched in this area. In the case of uncoated wire, this does not cause any problems, but a coating which is already on the wire before it is rolled into place, in particular the diamond coating which is typical of opening cylinders, would inevitably crack and even flake off in the event of plastic deformation of the base material of this nature. This would be altogether unacceptable for working of the cylinder. To avoid this problem, therefore, cylinders which have been provided with the clothing wire ("clothed cylinders") are provided with a nickel-diamond coating.

In DE-A 2433769, it has been proposed for clothing wire to be helically preshaped, with a diameter similar to the diameter of the cylinder body, and for this wire then to be fixed to the cylinder body.

A preshaped wire of this type may also already have been coated before being fitted to the cylinder body, as described, for example, in EP 0861930. According-to the prior art, however, the wire must have the needle finish required for the spinning process even before it is rolled into place, since the process which results in this surface state cannot be controlled on tightly coiled wires.

Since diamond coating of the required quality has only been mastered by a few commission processors throughout the world, it is necessary for the cylinders which have already been fitted with the clothing wire or the precoiled, needle-finished wire to be transported to the commission processor and then transported back to the OE machine manufacturer following the treatment.

Because of this very laborious production sequence, providing opening cylinders for the end user is very expensive and involves inordinately long delivery times.

The entire sequence is not only time-consuming and expensive, but also involves a considerable risk of rejects, since even slight impacts on the clothing wire tips, which are often inevitable in the numerous handling operations which are still to take place after the clothing has been fitted, to the cylinder may lead to deformation and make the cylinder unusable.

Preferred materials used for the cylinder base body are aluminum alloys, for weight reasons. Nickel-diamond coating of the cylinder body is not necessary, since it is not exposed to any significant wear and aluminum materials are usually also sufficiently corrosion-resistant.

BRIEF DESCRIPTION OF THE INVENTION

The present invention is based on the object of providing a process which allows rapid and inexpensive production of opening cylinders for OE spinning.

The object is achieved by a process for producing a clothing wire which is suitable for fitting to an opening-cylinder base body, wherein a raw wire which is customarily used to produce clothing wire is processed on end to form a wire coil, in which the teeth of the wire are perpendicular to the coil axis and which has a diameter which corresponds to the diameter of the opening-cylinder base body or differs by at most ±5% from the diameter of the opening-cylinder base body, and the wire coil is pushed loosely onto a support device and, together with this device, is introduced into plating unit, the process steps which are customarily used for the deburring of the raw wire and the nickel-diamond coating of a clothed opening cylinder taking place in the plating unit, and the clothing wire being removed from the plating unit.

The process according to the invention allows the manufacturer of opening cylinders to reduce the delivery time for cylinders based on the customer's specification from approximately 8 weeks to approximately 4 weeks without it being necessary to hold a considerable stock of expensive needle-finished clothing wire. In addition, direct cost savings are achieved by a reduction in the reject rate caused by damage and by eliminating the need for complete cylinders to be transported from manufacturer to nickel-diamond coating plant.

Starting from inexpensive raw wire, the process according to the invention provides a clothing wire which has been optimized in accordance with the customer's specification, has the active geometry of the clothing wire tips which is required for the cylinder to function optimally, at lower costs than those involved in the prior art, and bears the nickel-diamond coating which is required for the required long-term spinning performance to be achieved.

BRIEF DESCRIPTION OF THE DRAWINGS

FIG. 1 is a partial cut-away view of a clothed opening cylinder.

FIG. 2(*a*) is a view in cross-section of a needle finished clothing wire.

FIG. 2(*b*) is a side view of a needle finished clothing wire.

DETAILED DESCRIPTION OF THE INVENTION

In the process according to the invention, the raw wire is preferably obtained in commercially available elastically rolled spools with a diameter of approx. 500 mm. Manufacturers of a raw wire of this type include for example Graf in CH-Rapperswil or Hollingsworth in D-Neubulach.

The wire stretches as it is unrolled from the spool. The methods which are customarily used in the production of coil springs are preferably employed to process the wire on end to form coils with an internal diameter which corresponds to the diameter of the opening-cylinder base body or differs from this diameter by at most ±5%. Methods of this type are known, for example, from Meissner/Wanke; Handbuch Federn 2nd edition 1993, pages 62/63, Verlag Technik Berlin-Munich.

The length of these coils depends on the size of the dip baths which are available for further treatment in the electroplating unit. The diameter of these coils depends on the cylinder base body on which the clothing wire is to be fitted after it has passed through the process according to the invention.

As is known from the production of coil springs, the coil diameter is substantially dependent on the diameter of the mandrel used. Owing to the spring-back after coiling, which differs according to the materials' properties of the raw wire, the diameter of the mandrel therefore has to be a certain amount smaller, by a factor which can be determined empirically.

To treat its surface, the wire coil is pushed loosely onto a support device and introduced into an automated plating unit together with this support device. It is preferable to use an automated plating unit in which the nickel-diamond dispersion layering of the clothed opening cylinders takes place in the usual way.

Hitherto, plating units have predominantly been used only for the deposition of metallic coatings, such as the nickel-diamond layer on finished components, which must not be attacked or geometrically changed by the bath chemicals employed.

Material-removing processes, such as for example the production of the needle finish, are carried out beforehand in dedicated installations, in particular if high demands are imposed on the dimensional accuracy of geometrically complicated components, as is the case for clothing wire for OE opening cylinders.

It is not readily possible for a process involving defined material removal and metal deposition successively to be carried out without flaws by purely chemical means in a continuous surface treatment process. Therefore, it was not obvious to try the economically attractive combination of these two treatment steps in a single pass.

Specifically, the following reasons argue against chemical shape deburring of wire coils immediately followed by metal deposition:

The dissolution of material which is desirable in chemical shape deburring inevitably also entails the undesirable exposure of insoluble constituents of the material.

Depending on the steel grade used, these insoluble constituents may be impurities (e.g. inclusions such as $SiO_2$) and/or alloying elements (e.g. carbon).

During deburring of a straight wire according to the prior art in a continuous process, the impurities adhering to the wire surface can be reliably removed if the wire is passed through a dedicated cleaning bath with ultrasonic vibrators arranged at the sides.

During cleaning of a precoiled wire according to the invention, this process does not have the desired success, since the ultrasonic cleaning is impaired to a considerable extent by geometric shielding effects.

Direct metal coating of this surface leads to flaws such as unacceptable roughness and insufficient layer adhesion.

A further problem making it more difficult to carry out the chemical shape deburring and metal coating in a continuous process is the interim visual inspection of the deburred surface which is to be carried out if possible before the expensive nickel-diamond dispersion layer is applied.

The surface which is newly generated during deburring is extremely reactive; this means that when a test specimen is removed from the batch for visual assessment, together with the waiting time which is required until the assessment can be carried out, the wire can become unsuitable for subsequent metal coating owing to the corrosion which occurs.

Developments to the process which are listed below have now made it possible for the chemical deburring and the metal coating of the surface produced to be carried out in a continuous process despite the problems described.

The chemical deburring by means of a deburring solution preferably takes place with simultaneous mechanical assistance. The mechanical assistance is provided by the addition of insoluble solid particles to the deburring solution.

To achieve a high-quality surface within an acceptable treatment time during the chemical shape deburring, it is preferable for deburring solution to flow onto the raw wire in a controlled way.

This may, for example, be achieved, by pumping, i.e. circulating, the deburring solution. If solid particles are then added to the deburring solution, if these particles are of suitable quality and an appropriate size, they can effect a continuous cleaning process of the surface as a result of the constant relative movement between particle surface and component surface. Insoluble constituents of the material to be deburred are mechanically removed from the surface during the deburring process.

It is preferable to use solid particles with a diameter of 1–1000 $\mu$m. It is possible to use both organic solids (e.g. plastics materials, such as PTFE) and inorganic solids (e.g. boron nitride, boron carbide, etc.). The particles preferably have a concentration of 0.2 to 20 g/l.

The density of the particles expediently lies within a range which prevents them from floating on the deburring solution or, conversely, from forming a sediment too quickly. The density of the particles is therefore preferably in the range from 1.2 to 4.5 g/cm$^3$.

In all cases, it is a precondition that the solid particles must not be attacked by the deburring solution.

As has already been mentioned, interim inspection of the deburring result should follow the deburring operation.

To prevent corrosive attack on the deburred surface, a preferably electrolytic short-time passivation in an acidic, phosphate-containing solution is carried out immediately after the deburring step. Suitable processes are known in the prior art. The iron phosphate layer which is formed during this step protects the surface from corrosion and, once the continuous process has been resumed, can be removed again in a further acidic solution (activator) prior to the metal coating.

To achieve the maximum wear resistance of the coating, the process according to the invention may be followed by a heat treatment at least 335° C. for at least 1 hour.

The following examples explain the invention further.

EXAMPLE

Production of a Clothing Wire for Commercial Opening Cylinders

The cylinder base body has a diameter of 58 mm. A helical slot with a depth of 1 mm, into which the finished clothing wire is to be rolled, has been made in the base body.

An untreated raw wire is wound helically into coils on a cylindrical mandrel in such a manner that the teeth of the raw wire project perpendicular to the coil axis. To make it easy to subsequently fit the wire onto a cylinder body with a diameter of 58 mm, the wire coil should have an internal diameter of approx. 59 mm. To achieve this, a mandrel diameter of 54 mm was used.

The mandrel is clamped into the chuck of a lathe, which has wire-guide rollers mounted on its carriage. The raw wire is in the form of relatively large spools with a diameter of approx. 500 mm, and the teeth are in this case parallel to the spool axis.

A spool of raw wire is fitted onto a rotatable unrolling device. The end of the wire is pulled through between the guide rollers mounted on the lathe carriage, onto the coiling mandrel, and is clamped in a holding device mounted on the lathe chuck. The guide rollers are pressed onto the sides of the wire by spring force and are mechanically braked, so that they hold the wire under tension while the coiling operation is taking place. The advance of the carriage corresponds to the thickness of the wire foot, so that the turns of the coil formed bear directly against one another during the coiling operation. The length of the coil depends on the device available and/or the bath dimensions which are available for the further chemical treatment.

After the desired coil length has been achieved, the wire is cut and as a result the stresses are relieved. The residual elasticity leads to the coils springing back, so that the turns of the coil widen to the predetermined diameter of 59 mm. After the clamping device on the lathe chuck has been opened, it is easy to remove the finished coil from the mandrel.

A plurality of coils of raw wire produced in this way are fitted loosely onto support devices and are secured in the conveyor system of an automated electroplating unit together with these support devices. In addition, a few short pieces of wire are attached to the support devices in such a way that they are easy to remove.

The automated plating unit contains all the baths which are required for the material-removing surface treatment and for the nickel-diamond coating of the wire, including the necessary rinsing baths.

The following text describes a typical sequence for treating a clothing wire of type OB 20, which is preferably used for spinning cotton.

The treatment sequence involved in pretreatment of the wire may be carried out by purely chemical means or with electrolytic support. Corresponding pretreatment processes form part of the prior art (W. Riedel: Funktionelle Chemische Vernickelung [Functional Chemical Nickel-Plating], Leuze-Verlag, 1989, p. 177 Lehrgangsunterlagen Entgrat-Technik 95, TA Esslingen, Technologie der Galvanotechnik [Electroplating Technology], Gaida/Aβmann: Leuze Verlag, 1st edition, 1996). Details of the steps are therefore not given.

1. Alkaline hot degreasing at 70° C. for 10 minutes
2. Rinsing
3. Inhibited acid 60° C. for 5 minutes
4. Rinsing
5. Mechanically assisted chemical deburring for 10 minutes at 35° C.
6. Rinsing
7. Short-time passivation: electrolytic passivation in acidic, phosphate-containing solution
8. Removal of a piece of wire for visual inspection of the degree of rounding of the tips of the clothing wire. Depending on the result, repetition of steps 2 to 8 or 9. Removal of the iron phosphate layer and activation of the surface in 5 to 10% strength HCl for 2 min. at 30° C.
10. Rinsing
11. Insertion into the diamond coating bath, immersion time, depending on desired layer thickness, approx. 90 min. at 85° C.
12. Shower cleaning above the diamond bath
13. Ultrasonic cleaning Chemical deburring baths are supplied, for example, by Tritech in D-42207 Wuppertal and Poligrat in D-81829 Munich. The principal constituents of these baths are hydrogen peroxide, ammonium bifluoride, various acids and stabilizers.

The way in which chemical deburring baths operate, and the composition of such baths, are described in F. Schäfer; Entgraten-Theorie, Verfahren, Anlagen [Deburring Theory, Processes, Installations]; 1975, pages 160 to 166; Krausskopf-Verlag.

The solid particles described above are added to the deburring bath in order to mechanically assist the deburring process.

If a thin diamond-free nickel layer on top of the actual diamond layer is specified, steps 9 and 10 are repeated and the batch is dipped into a chemical nickel bath.

14. Chemical nickel-plating with an immersion time, depending on the desired layer thickness, of from 10 to 20 minutes at 85° C.
15. Rinsing
16. Removal from the automated unit.

To achieve the maximum wear resistance of the coating, a heat treatment is carried out at least 335° C., preferably at 350° C., for 2 hours.

The finished wire coils are once again visually inspected under a microscope to check for surface flaws.

We claim:

1. A process for producing a nickel-diamond coated clothing wire which comprises (1) forming a toothed raw clothing wire into a coil, in which the teeth of the wire are perpendicular to a coil axis, the coil having a diameter which corresponds to a diameter of an opening-cylinder base body with a tolerance of ±5%;

(2) mounting the wire coil loosely on a support device;

(3) cleaning the coil of raw clothing wire to form a cleaned coil of raw-clothing wire;

(4) deburring the cleaned coil of raw clothing wire in a mechanically assisted, chemical deburring zone to provide a coil of deburred clothing wire;

(5) applying the nickel-diamond coating to the deburred clothing wire to form a coated clothing wire; and (6) heating the coated clothing wire to a temperature above about 335° C. to form said nickel-diamond coated clothing wire.

2. The process as claimed in claim 1, wherein the mechanical assistance is provided by the addition of solid particles to a chemical deburring solution, said particles are not attacked by the deburring solution.

3. The process as claimed in claim 2, wherein said deburring solution flows in contact with the raw wire in a controlled way.

4. The process as claimed in claim 3, wherein the deburring solution is circulated in the deburring zone by being pumped.

5. The process of claim 4, wherein the solid particles have a diameter of 1–1000 $\mu$m.

6. The process of claim 3, wherein the solid particles have a concentration of 0.2 to 20 g/l.

7. The process of claim 4, wherein the solid particles have a concentration of 0.2 to 20 g/l.

8. The process of claim 4, wherein the density of the solid particles is in the range from 1.2 to 4.5 g/cm$^3$.

9. The process of claim 4, wherein a passivating coating is applied by an electrolytic short-time passivation in an acidic, phosphate-containing solution immediately after the deburring step.

10. The process of claim 3, wherein the solid particles have a diameter of 1–1000 $\mu$m.

11. The process of claim 3, wherein the density of the solid particles is in the range from 1.2 to 4.5 g/cm$^3$.

12. The process of claim 3, wherein a passivating coating is applied by an electrolytic short-time passivation in an acidic, phosphate-containing solution immediately after the deburring step.

13. The process as claimed in claim 2, wherein the solid particles have a diameter of 1–1000 $\mu$m.

14. The process of claim 13, wherein the solid particles have a concentration of 0.2 to 20 g/l.

15. The process of claim 13, wherein the density of the solid particles is in the range from 1.2 to 4.5 g/cm$^3$.

16. The process of claim 13, wherein a passivating coating is applied by an electrolytic short-time passivation in an acidic, phosphate-containing solution immediately after the deburring step.

17. The process as claimed in claim 2, wherein the solid particles have a concentration of 0.2 to 20 g/l.

18. The process of claim 17, wherein the density of the solid particles is in the range from 1.2 to 4.5 g/cm$^3$.

19. The process of claim 17, wherein a passivating coating is applied by an electrolytic short-time passivation in an acidic, phosphate-containing solution immediately after the deburring step.

20. The process as claimed in claim 2, wherein the density of the solid particles is in the range from 1.2 to 4.5 g/cm$^3$.

21. The process of claim 20, wherein a passivating coating is applied by an electrolytic short-time passivation in an acidic, phosphate-containing solution immediately after the deburring step.

22. The process of claim 2, wherein a passivating coating is applied by an electrolytic short-time passivation in an acidic, phosphate-containing solution immediately after the deburring step.

23. The process as claimed in claim 1, wherein a passivating coating is applied by an electrolytic short-time passivation in an acidic, phosphate-containing solution immediately after the deburring step.

24. The process of claim 1, wherein a nickel coating is applied over the nickel-diamond coating of the coated clothing wire.

* * * * *